US010383426B2

(12) United States Patent
Rittenhouse et al.

(10) Patent No.: US 10,383,426 B2
(45) Date of Patent: Aug. 20, 2019

(54) LOAD DISTRIBUTION SYSTEM

(71) Applicant: National Molding LLC, Miami Lakes, FL (US)

(72) Inventors: James Rittenhouse, Miami Lakes, FL (US); Derek Mir, Miami Lakes, FL (US)

(73) Assignee: NATIONAL MOLDING LLC, Miami Lakes, FL (US)

( * ) Notice: Subject to any disclaimer, the term of this patent is extended or adjusted under 35 U.S.C. 154(b) by 147 days.

(21) Appl. No.: 15/585,915

(22) Filed: May 3, 2017

(65) Prior Publication Data

US 2018/0317634 A1 Nov. 8, 2018

(51) Int. Cl.
*A45F 3/10* (2006.01)

(52) U.S. Cl.
CPC ..... *A45F 3/10* (2013.01)

(58) Field of Classification Search
CPC ..... A45F 3/10; A45F 2003/127; A45F 2003/144; A45F 2003/146
USPC ..... 224/272, 631, 632
See application file for complete search history.

(56) References Cited

U.S. PATENT DOCUMENTS

| | | | | |
|---|---|---|---|---|
| 5,464,137 | A * | 11/1995 | Shirdavani | A41F 9/002 2/45 |
| 7,549,970 | B2 * | 6/2009 | Tweardy | A61F 5/055 128/869 |
| 7,591,401 | B2 * | 9/2009 | Sandler | A45F 3/14 224/201 |
| 7,654,972 | B2 * | 2/2010 | Alleyne | A61F 5/026 602/19 |
| 8,006,877 | B2 * | 8/2011 | Lowry | A45F 3/04 224/262 |
| 8,353,433 | B2 * | 1/2013 | Wrigley | A62B 25/00 128/205.22 |
| 9,220,333 | B2 * | 12/2015 | Losos | A45F 3/10 |
| 9,545,144 | B2 * | 1/2017 | Gill | A45F 3/04 |
| 9,629,443 | B2 * | 4/2017 | Searle | A45F 3/08 |
| 2011/0105971 | A1 * | 5/2011 | Ingimundarson | A61F 5/024 602/19 |
| 2011/0152737 | A1 * | 6/2011 | Burke | A61F 5/026 602/19 |
| 2012/0192335 | A1 * | 8/2012 | Crye | A41D 13/0007 2/102 |

* cited by examiner

*Primary Examiner* — Derek J Battisti

(57) ABSTRACT

An exemplary embodiment includes a load distribution system including an outer shell configured to attach to a belt on a user's waist. The outer shell at least partially supports a load adjacent to the user's back. The outer shell also includes a height adjustment system operable by the user to select a desired height and a buffer system protecting the user from shocks associated with the load moving a distance in congruence with a cadence of the user's movement.

20 Claims, 13 Drawing Sheets

LOAD DISTRIBUTION SYSTEM

TECHNICAL FIELD

Embodiments of this invention are directed to a load distribution system for reducing the load on a user's back.

BACKGROUND

Hikers, soldiers and outdoorsmen often carry extremely heavy backpacks and other equipment into the field. A backpack or harness that properly distributes a load will slow exhaustion and improve the endurance of a user. The user's waist can support more weight than their back. Some backpacks take advantage of this by using a frame to transfer weight from a user's back to their waist. These frames have significant drawbacks that make them unsuitable to today's users.

These frames limit a user's mobility because they lack any articulation. The frames are typically made of solid metallic members lacking any flexibility or articulation in any joints.

The frames are not easily adjusted, which may reduce their ability to transfer weight from a user's back to their waist. A pack may come with a single size frame with no ability to customize the size or fit of the frame for a user.

The frames also transfer all the impact force of the up and down motion of the pack to the user through the solid frame.

Accordingly, there is a need for a device with a sufficient amount of adjustment and articulation to comfortably and efficiently transfer weight to a user's waist.

SUMMARY

An exemplary embodiment includes a load distribution system including an outer shell configured to attach to a belt on a user's waist. The outer shell at least partially supports a load adjacent to the user's back. The outer shell also includes a height adjustment system operable by the user to select a desired height and a buffer system protecting the user from shocks associated with the load moving a distance in congruence with a cadence of the user's movement.

An exemplary embodiment includes a load distribution system including an outer shell configured to attach to a user's belt and a load adjacent to the user's back. The outer shell includes: a belt interface attached to the user's belt, a pivot saddle hingedly attached to the belt interface, an inner spine attached to the pivot saddle, an outer spine attached to the inner spine via a height adjustment system and a buffer system, and a shelf attached to the outer spine supporting the load. The height adjustment system is controlled by the user to select a desired height. The buffer system protects the user from shocks associated with the load moving a distance in congruence with a cadence of the user's movement.

An exemplary embodiment includes a load distribution system. The load distribution system includes a base assembly, a center batten assembly and a shelf. The base assembly is configured to attached to a waist belt. The center batten assembly has an upper end and a lower end. The lower end of the batten is pivotably connected to the base assembly and extends upward from the base assembly to the center batten assembly's upper end. The center batten assembly includes a buffering system. The shelf is connected to the center batten assembly. The center batten assembly is frictionally attached to the base assembly and the shelf and removable by a user.

DESCRIPTION OF DRAWINGS

The accompanying drawings illustrate various non-limiting exemplary innovative aspects in accordance with the present descriptions.

DETAILED DESCRIPTION

While the presently disclosed invention is capable of being embodied by multiple different forms, the drawings illustrate a number of exemplary embodiments that are discussed in greater detail hereinafter. It should be clear to one having ordinary skill in the art that the figures and embodiments discussed herein are exemplary in nature, and are not intended to limit the invention to a specific illustrated embodiment.

In this disclosure, the use of the disjunctive is intended to include the conjunctive. the use of the definite article or indefinite article is not intended to indicate cardinality. In particular, a reference to "the" object or "a" object is intended to denote also one of a possible plurality of such objects.

Figure 1:
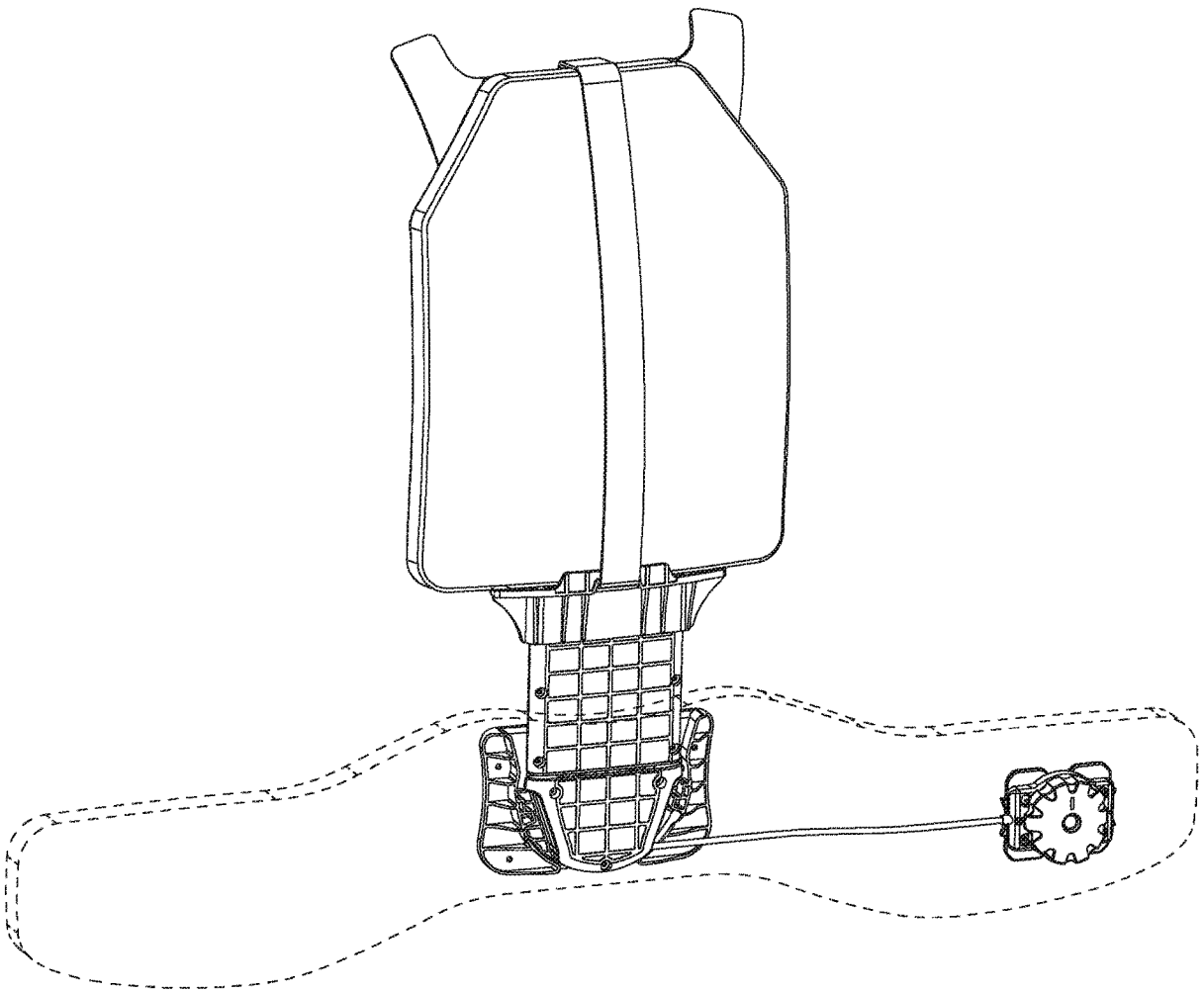
FIG. 1 is an exemplary illustration of a load distribution system.
Figure 2:
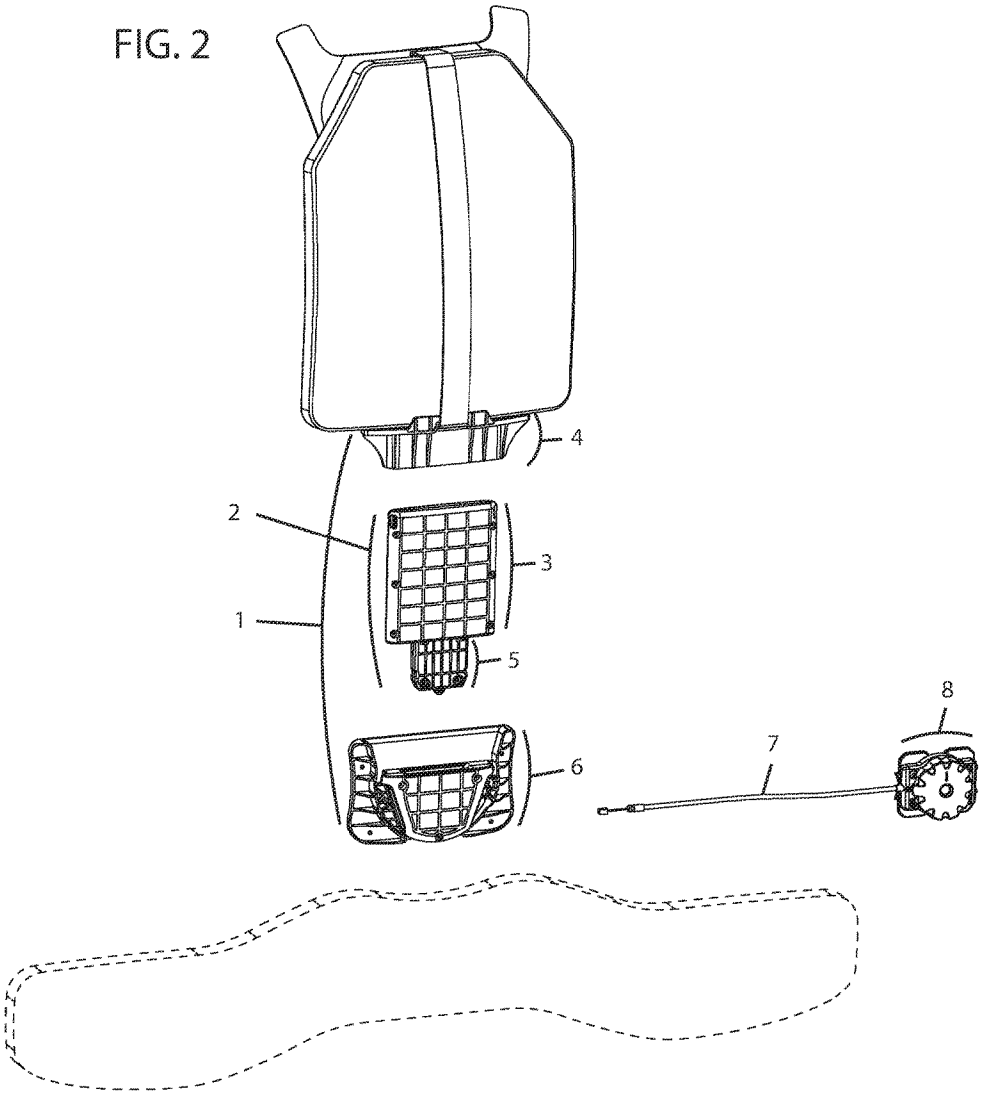
FIG. 2 is an exemplary illustration of a load distribution system.
Figure 3:
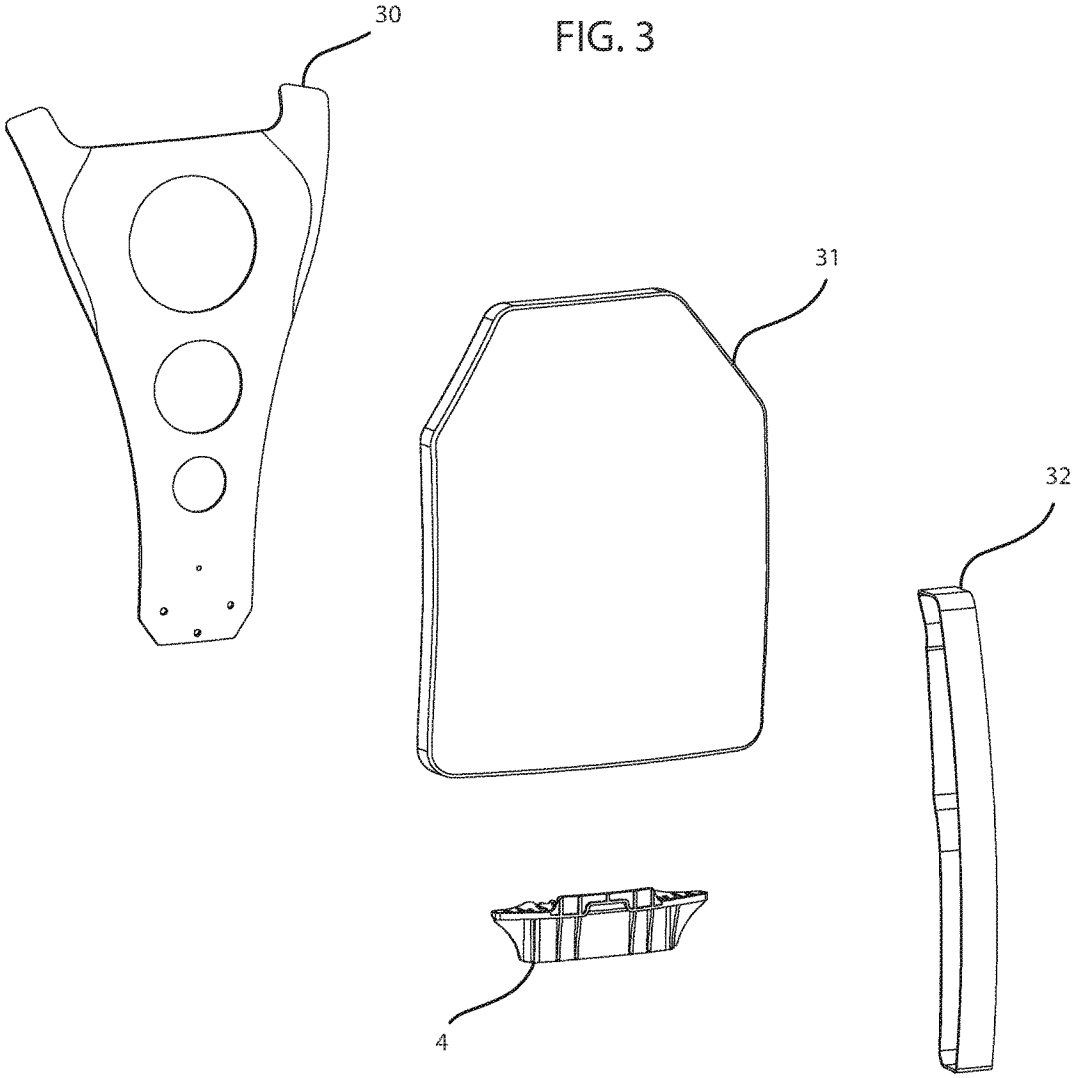
FIG. 3 is an exemplary illustration of a plate assembly of a load distribution system.

Referring to the figures, FIG. 1 is an overview of the load distribution system. The outer shell 1 connects to a user's belt and a load on the user's back. The outer shell 1 is a support device that transfers weight from the user's back to the user's waist. A user's waist can carry more weight than their backs reducing fatigue from carrying a heavy load over a long distance.

In an exemplary embodiment, the outer shell 1 includes a center assembly 2, a shelf 4 and a base assembly 6. The components of the outer shell are modular. These components can be replaced without tools by a user with minimal training in the field. These components are interchangeable, e.g. the center assembly 2, base assembly 6 and the shelf 4 from different sets can be easily combined. The components of the outer shell, including the center assembly 2, base assembly 6 and the shelf 4 may be constructed from nylon, polycarbonate, acetal or a similar material.

Figure 4:
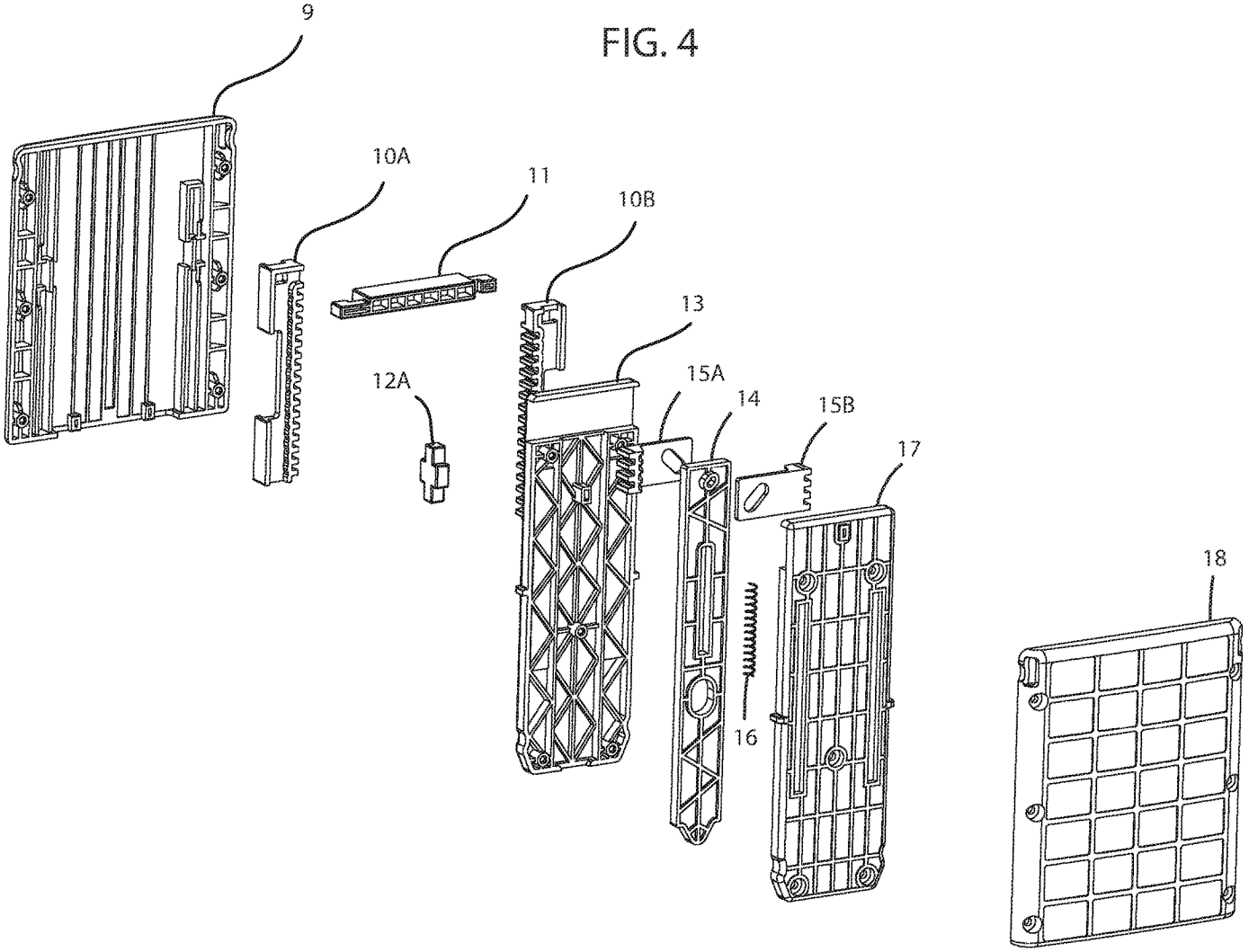
FIG. 4 is an exemplary illustration of a center assembly of a load distribution system.

In an exemplary embodiment as illustrated in FIG. 4, the center assembly 2 may be made in a plurality of sizes, e.g.

a small, medium or large, to accommodate users of different heights. The center assembly 2 includes an inner spine 5 and an outer spine 3. The inner spine 5 and the outer spine 3 are slideably attached with the inner spine 5 partially enclosed within the outer spine 3. A height adjustment system allows the inner spine 5 and an outer spine 3 to lock relative to each other or unlock to allow the inner spine 5 and an outer spine 3 to move relative to each other. Using the height adjustment system allows a user to adjust the length of the center assembly 2. Replacing the center assembly 2 with one having the appropriate size for the user and adjusting the length of the center assembly 2 allows a user to customize the length of the outer shell 1 to accommodate the user's height and better distribute the weight of the load to the user's waist.

Figure 6:
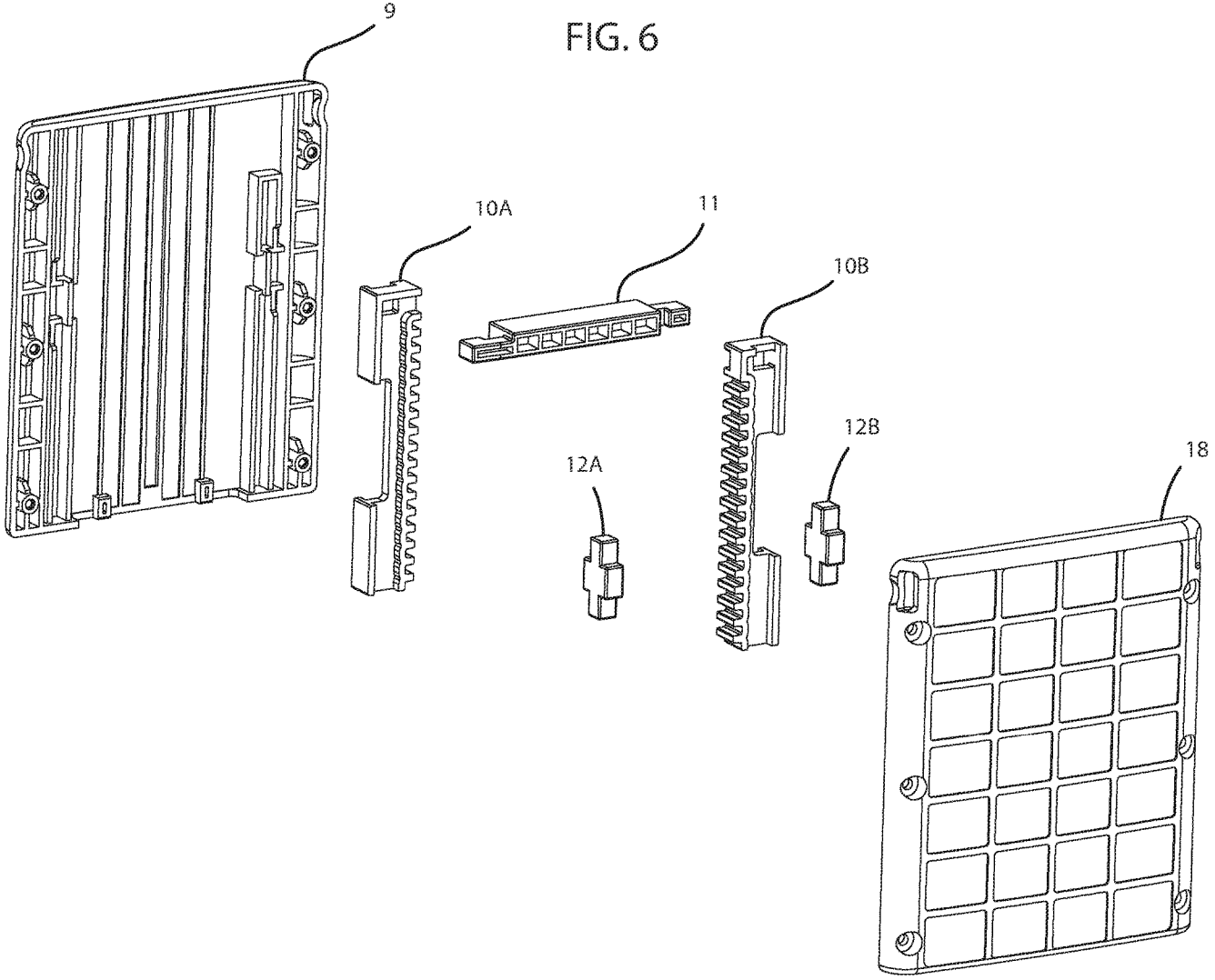
FIG. 6 is an exemplary illustration of an outer spine of a load distribution system.

In an exemplary embodiment as illustrated in FIG. 6, the outer spine 3 includes a first outer cover 18 and a second outer cover 9. The first outer cover 18 and the second outer cover 9 form a shell that covers the internal components of the outer spine 3 and provide the structure to which these components may attach. The outer spine 3 may be inserted into a receptacle in the shelf 4. The outer spine 3 has detents or a similar device that holds the outer spine 3 in the shelf 4. The outer spine 3 may be removed from the shelf 4 without the user of a tool by the user applying sufficient force.

A floating track 10A, B runs along the vertical direction in the outer spine 3. The outer spine 3 may contain one or more floating tracks 10A, B. The floating tracks 10A, B may further be contained within a groove built into the first outer cover 18 and/or the second outer cover 9, allowing the floating tracks 10A, B to move up and down within a contained area. Each floating track 10A, B has at least one side covered with a locking system. The locking system may include teeth, a high friction surface or the like. Multiple floating tracks 10A, B may be connected with one or more bridges 11. Each floating tracks 10A, B has a top and bottom stopper that engages one or more bumpers 12A, B. The bumpers 12A, B reduce the force of the impact resulting from the floating tracks 10A, B reaching the end of their traveling distance. This reduces the impact transmitted through the load distribution system through the user. The bumpers 12A, B are made of a compressible material, e.g. rubber, soft plastic, foam or the like. The bumpers 12A, B may be attached to the first outer cover 18 and/or the second outer cover 9. The bumpers 12A, B may be attached with friction, welding, an adhesive or the like.

Figure 5:
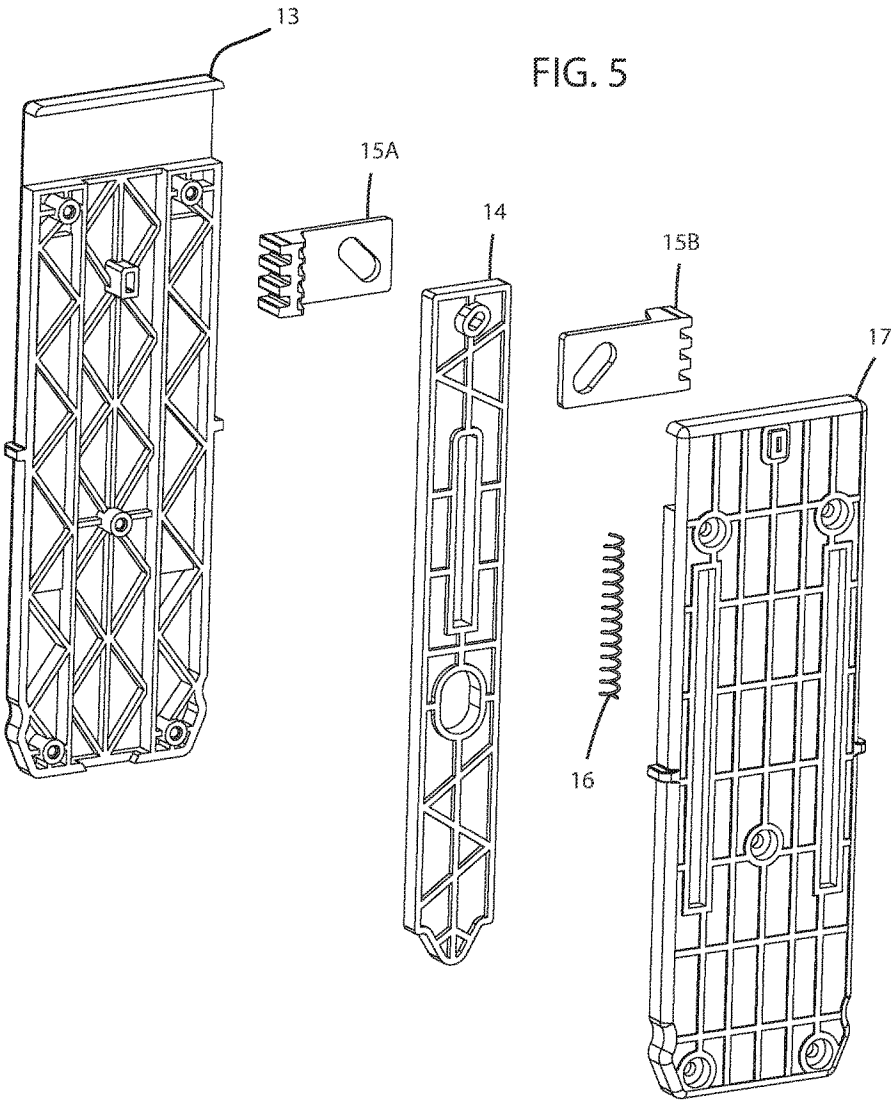
FIG. 5 is an exemplary illustration of an inner spine of a load distribution system.

In an exemplary embodiment as illustrated in FIG. 5, the inner spine 5 includes a first inner cover 13 and a second inner cover 17. The first inner cover 13 and the second inner cover 17 form a shell that covers the internal components of the inner spine 5 and provide the structure to which these components may attach. The inner spine 5 may include one or more trigger bars 14. The trigger bar 14 runs along the vertical direction within the inner spine 5. The first inner cover 13 and/or the second inner cover 17 includes one or more grooves containing the trigger bar 14. The trigger bar 14 is held in a locked position by a spring 16. The spring 16 may alternatively be made of foam or another resilient material. The trigger bar 14 interfaces with one or more locking slides 15A, B about the upper end of the trigger bar 14. The first inner cover 13 and/or the second inner cover 17 includes one or more grooves containing the locking slides 15A, B. The locking slides 15A, B engage the floating tracks 10A, B in the locked position and disengage from the floating tracks 10A, B in an unlocked position.

While the inner spine 5 may move with respect to the outer spine 3 when the trigger bar is 14 is in an unlocked state the inner spine 5 cannot be removed from the outer spine 3. The inner spine 5 is captured by the outer spine 3. For example, tabs may be placed about the center of the inner spine 5. These tabs may engage an opening of the shell of the outer spine 3 preventing the inner spine 5 from being removed.

The height adjustment system includes several components in the outer spine 3 and inner spine 5. In the locked state there is no triggering force applied to the trigger bar 14. The trigger bar 14 interfaces with the lock slides 15A, B and causes the locking slides 15A, B to engage the floating tracks 10A, B. As long as the locking slides 15A, B engage the floating track 10A, B all the components in the inner spine 5 will move with the floating track 10A, B.

In order for a user to adjust the length of the center assembly 2 a force must be applied to the trigger bar 14 to enter an unlocked position. In an exemplary embodiment, in the unlocked state the trigger bar 14 interfaces with the locking slides 15A, B causing them to retract into the inner spine 5. This action causes a minimal amount of force necessary to be applied to the locking slides 15A, B to disengage from the floating tracks 10A, B.

The center assembly 2 includes a buffer system to absorb impacts. As described above, the floating tracks 10A, B slide within the outer spine 3. The floating tracks 10A, B can substantially travel the entire length of the outer spine 3. As the floating tracks 10A, B and any components that engage the floating tracks 10A, B move up and down their movement may be restricted and they may impact the inner structure of the outer spine 3. The outer spine 3 contains bumpers 12A, B that contact the floating tracks 10A, B and reduce the force of the impact with the outer spine 3.

Figure 7:
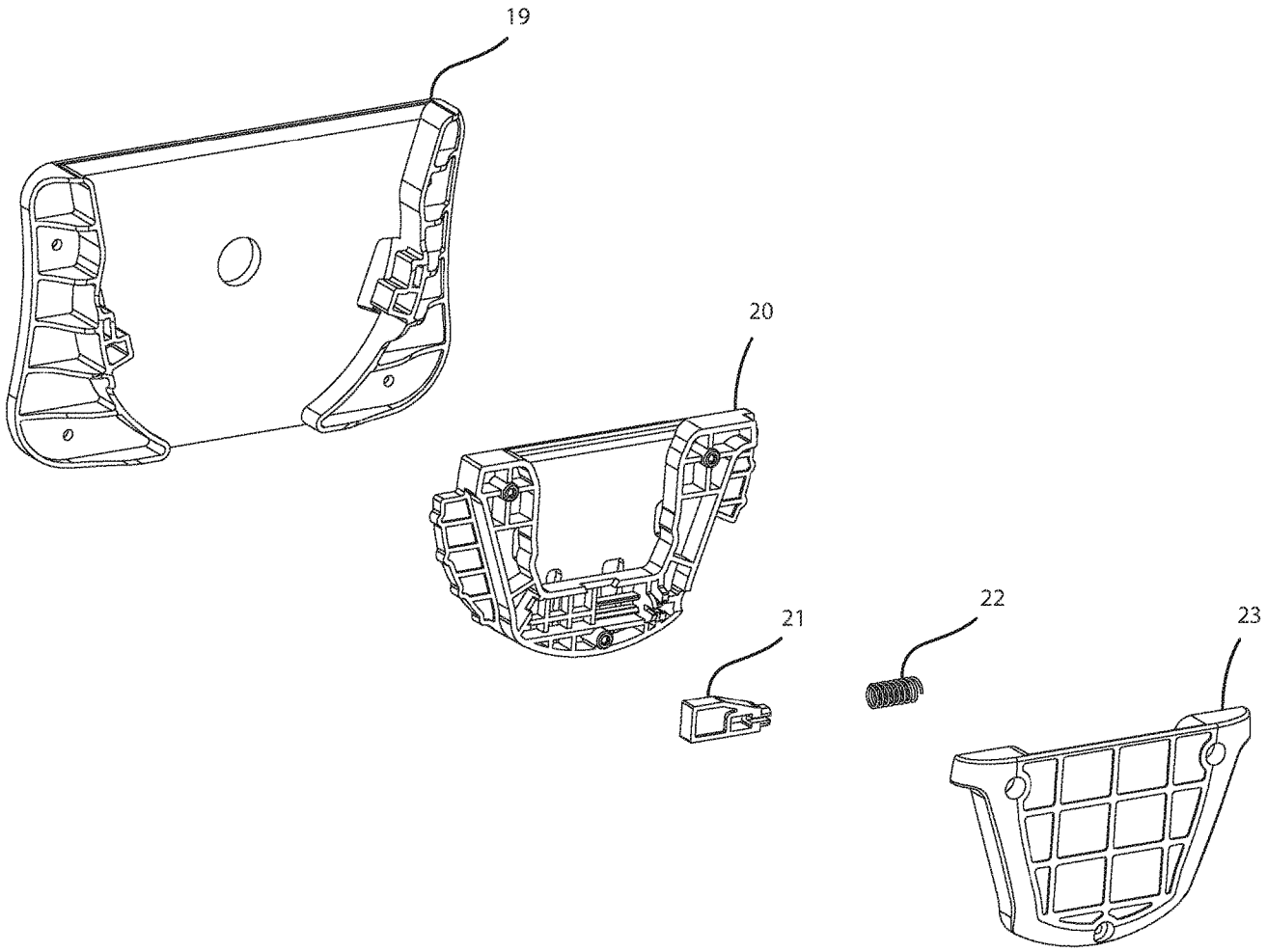
FIG. 7 is an exemplary illustration of a base assembly of a load distribution system.

In an exemplary embodiment as illustrated in FIG. 7, the base assembly 6 connects the center assembly 2 with the user's belt. The base assembly includes a belt interface 19, a pivot saddle 20, a trigger ramp 21, a spring 22 and a pivot saddle cover 23. The belt interface 19 may be attached permanently or removably to the belt. The belt interface 19 may be fastened to the user's belt using friction, buttons, clips, hook-and-loop, rivets, adhesives or any other suitable fastener. The belt interface 19 is hingedly attached to the pivot saddle 20. The hinge allows the pivot saddle 20 to tilt in either direction. The pivot saddle and the belt interface interact to restrict this tilt to about fifteen degrees laterally in either direction. The rotation of the pivot saddle 20 is stopped when the pivot saddle contacts an abutment in the belt interface 19. The pivot saddle 20 connects to the pivot saddle cover 23. The pivot saddle cover 23 and the pivot saddle 20 form a recess for receiving the inner spine 5. Several detents in this recess retain the inner spine 5. The inner spine 5 may be removed toollessly from this recess by pulling on it with the sufficient force. A trigger ramp 21 is exposed at the bottom of this recess.

The trigger ramp 21 is mostly contained within a cavity in the pivot saddle 20 and/or the pivot saddle cover 23. The trigger ramp 21 is maintained in the locked position by a spring 22. The spring 22 may alternatively be made of foam or another resilient material. The trigger ramp 21 may move from a locked position to an unlocked position. In the unlocked position the trigger ramp 21 applies a force to the trigger bar 14, forcing the trigger bar 14 into the unlocked position. The trigger ramp 21 may be manipulated by the height adjustment interface 8.

Figure 8A:
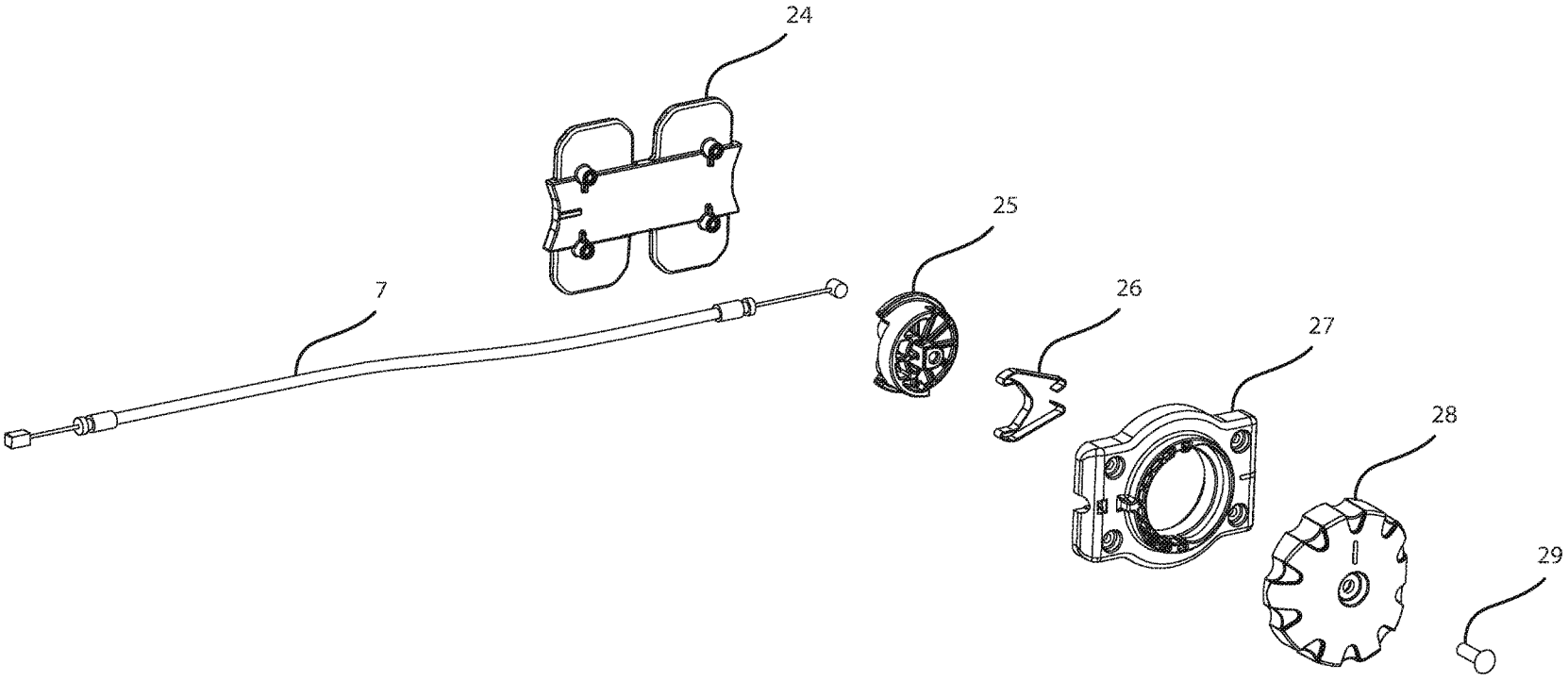
FIG. 8A is an exemplary embodiment of height adjustment interface of a load distribution system.
Figure 8B:
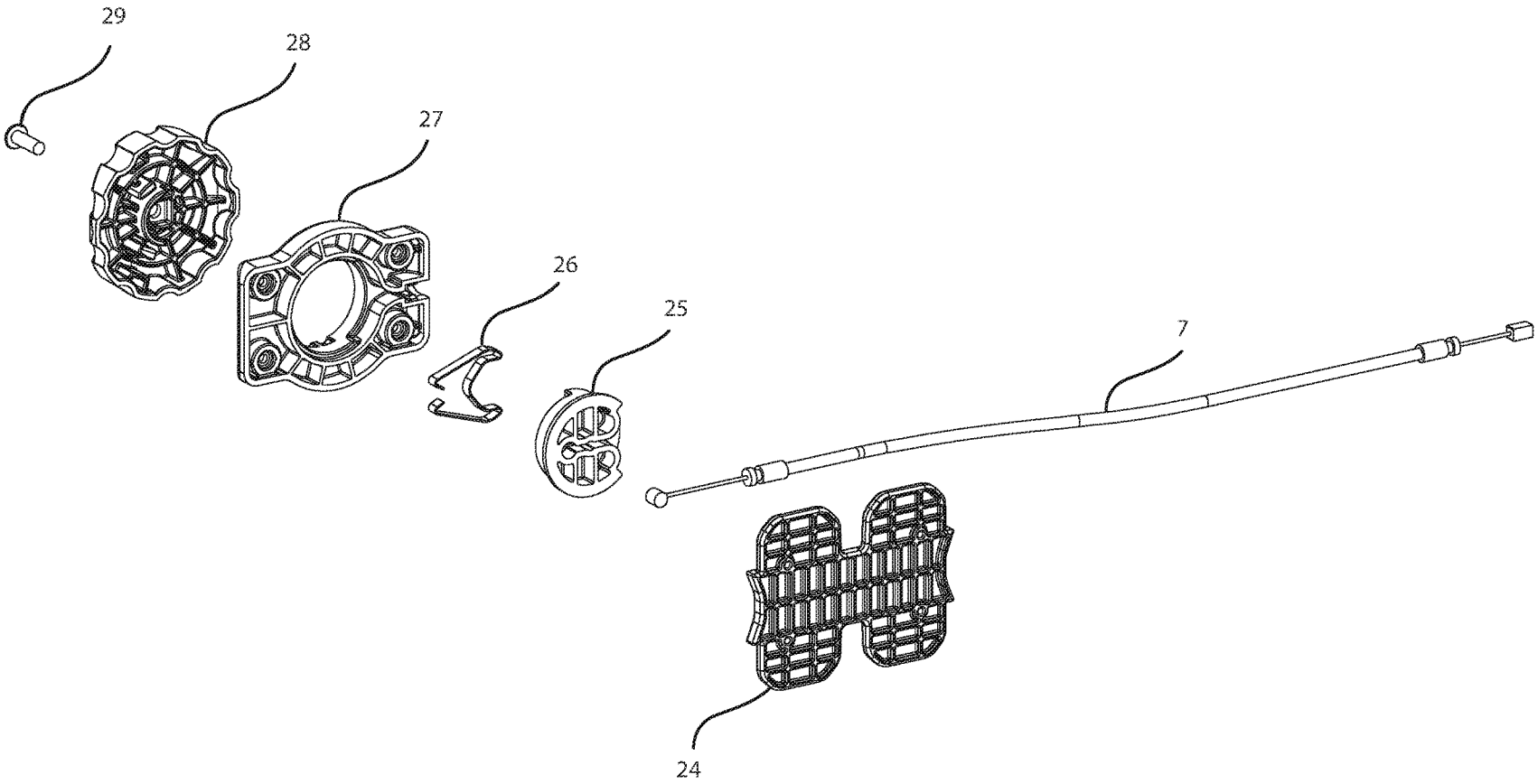
FIG. 8B is an exemplary embodiment of height adjustment interface of a load distribution system.
Figure 9A:
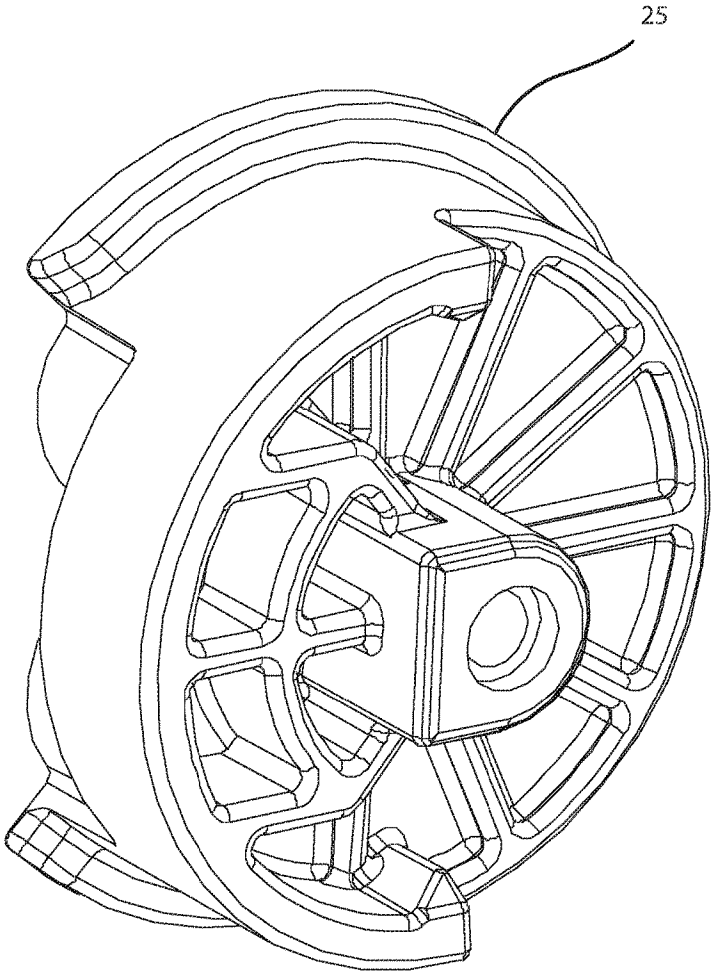
FIG. 9A is an exemplary embodiment of a portion of a height adjustment interface of a load distribution system.
Figure 9B:
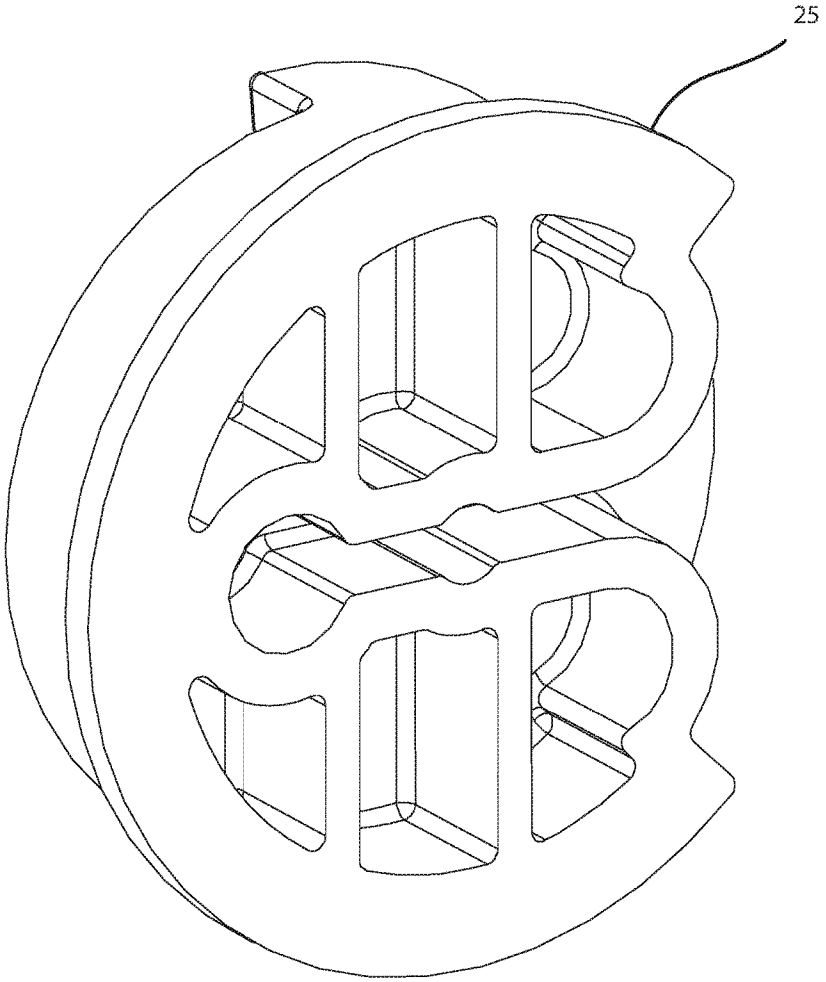
FIG. 9B is an exemplary embodiment of a portion of a height adjustment interface of a load distribution system.
Figure 9C:
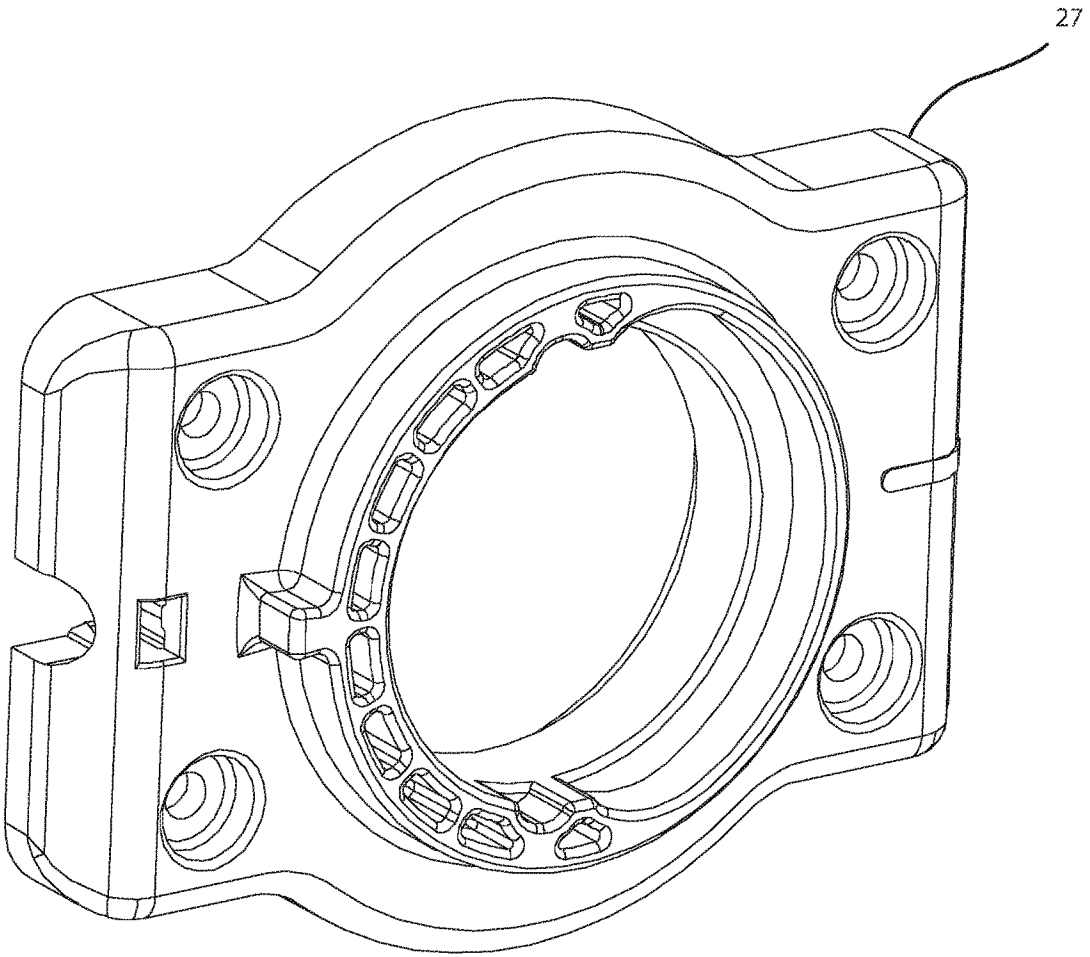
FIG. 9C is an exemplary embodiment of a portion of a height adjustment interface of a load distribution system.
Figure 9D:
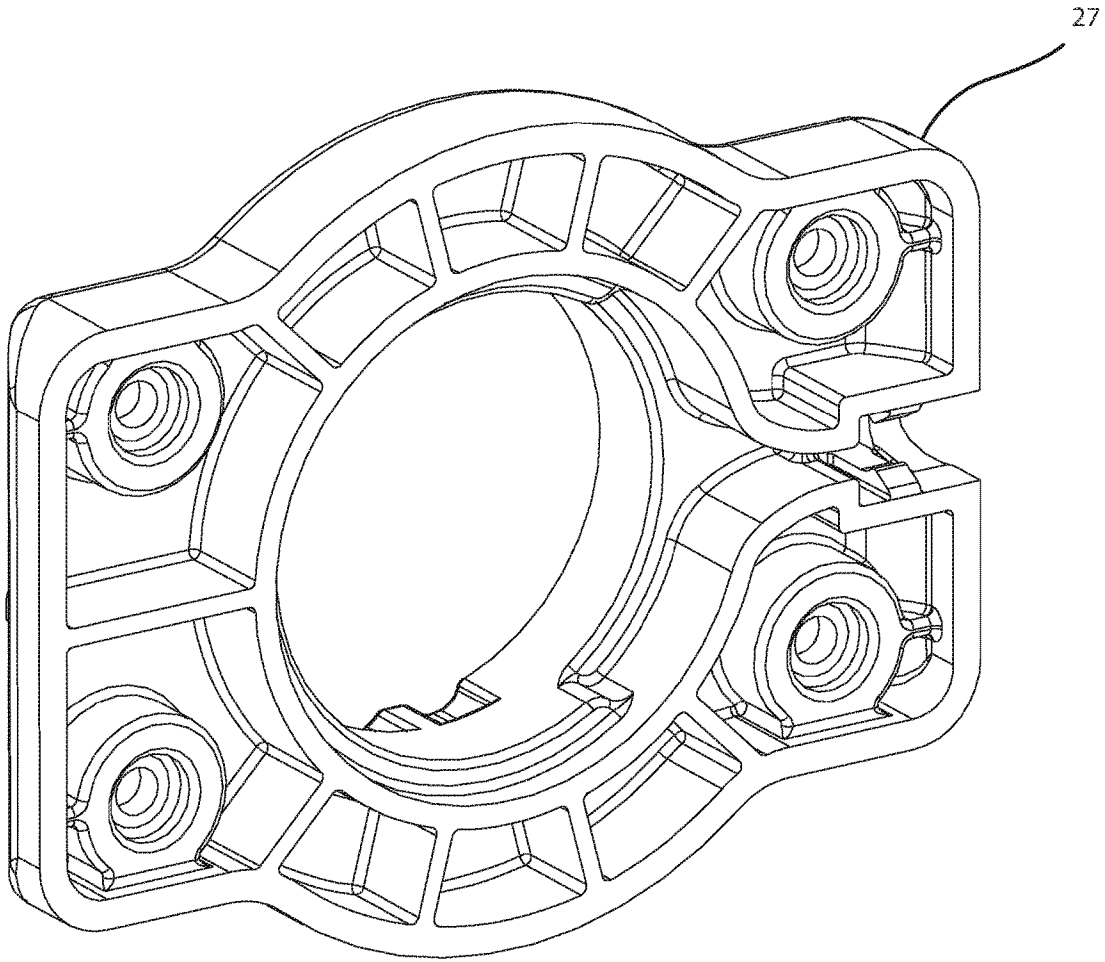
FIG. 9D is an exemplary embodiment of a portion of a height adjustment interface of a load distribution system.

In an exemplary embodiment as illustrated in FIG. 8A, the user can lock or unlock the height adjustment system using the height adjustment interface 8. The height adjustment interface 8 may be attached permanently or removably to the belt. The height adjustment interface 8 interface may be fastened to the user's belt using friction, buttons, clips, hook-and-loop, rivets, adhesives or any other suitable fastener. The height adjustment interface 8 communicates with the trigger ramp 21 via a cable, pneumatic tube or other suitable means. The height adjustment interface 8 in a neutral state places the height adjustment system in the locked position. The height adjustment interface 8 may create a tactile and/or audible sensation, e.g. a click, when activated to alert the user. The height adjustment interface 8 may be a knob, trigger, button, switch or other similar device.

Outdoorsmen and other users have to deal with fatigue caused by carrying heavy loads on their backs. A user's endurance can be improved by transferring a significant portion of the load from their back on to their waist. Very heavy loads tend to bounce up and down in concert with the cadence of a user's walk. Reducing the force from this series of impacts improves a user's endurance.

In an exemplary embodiment, a load carried on the shelf 4 is connected to the outer spine 3. While a user walks, the load and all the components connected to the load move up and down with the cadence of the user's walk. Normally, the outer spine 3 would move up and down sliding on the grooves containing the floating tracks 10A, B. If the amount of travel increases due to the user's increase in speed, jump, fall etc. the outer spine 3 will impact the bumper 12A, B. The bumper 12A, B will decrease the amount of force exerted on the user, improving the user's overall endurance.

The load distribution system may be calibrated to the individuals size. If the size of the load distribution system is improperly calibrated the user may have a decreased range of motion and may needlessly cause harder and more frequent impacts than normal when the bumper 12A, B and the floating tracks 10A, B impact. The load distribution system allows the size to be calibrated at least two ways. The center assembly 2 may be manufactured in different sizes accounting for different sized users. When the user is fitted for the load distribution system he needs to only select the center assembly 2 of the appropriate size and connect it to the shelf 4 and base assembly 6. The user can also adjust the height of the individual center assembly 2.

In an exemplary embodiment, the user activates the height adjustment interface 8. This causes the trigger ramp 21 to move from the locked to unlocked position. This exerts a force on the trigger bar 14 moving it from the locked to unlocked position. The trigger bar 14 interfaces with the locking slides 15A, B causing them to retract. Once the locking slides 15A, B are retracted the inner spine 5 can be moved independently of the floating tracks 10A, B and the other components of the outer spine 3. When the desired size is selected the user can return the height adjustment interface 8 to the neutral position. This causes the locking slides 15A, B to reengage the floating tracks 10A, B. This again limits the movement of the load to the distance the outer spine 3 can travel before the bumpers 12A, B impact the floating track 10A, B.

A user carrying a heavy load is going to have a limited amount of movement. If the user leans to much in any given direction the heavy load will apply a significant torque and the user will fall over. In this context, the load distribution system provides the user with sufficient articulation. The pivot saddle 20 is hingedly attached to the belt interface 19. This allows the user to lean left or right without being encumbered by the load distribution system. The belt being attached to the user's waist allows the user to bend forward or backwards a sufficient amount in most situations considering the large heavy load the user is carrying on his back.

It should be understood that this description (including the figures) is only representative of some illustrative embodiments. For the convenience of the reader, the above description has focused on representative samples of some possible embodiments, and samples that teaches the principles of the invention. The description has not attempted to exhaustively enumerate all possible variations. That alternate embodiments may not have been presented for a specific portion of the invention, or that further undescribed alternate embodiments may be available for a portion, is not to be considered a disclaimer of those alternate embodiments. One of ordinary skill will appreciate that many of those undescribed embodiments incorporate the same principles of the invention as claimed and others are equivalent.

We claim:

1. A load distribution system comprising: an outer shell configured to attach to a belt on a user's waist; the outer shell at least partially supporting a load adjacent to the user's back and including a center assembly; the center assembly including: a height adjustment system operable by the user to select a desired height; and a buffer system protecting the user from shocks associated with the load moving a distance up and down in congruence with a cadence of the user's movement; wherein the buffer system includes a bumper restricting the distance the load can travel to a limited distance about the desired height; wherein the center assembly includes an outer spine including a floating track, and wherein the floating track is oriented from a top to a bottom of the center assembly and slides substantially along a length of the outer spine; the buffer system includes a bumper attached about a middle of the floating track; and the floating track includes a stopper to contact the top and bottom of the bumper.

2. The load distribution system of claim 1, wherein the bumper is capable of being compressed from both the top and the bottom.

3. The load distribution system of claim 2, wherein the bumper is made of a compressible material.

4. The load distribution system of claim 1, wherein the outer shell includes:

a belt interface for attaching the outer shell to the belt on the user's waist;

a pivot saddle hingedly attached to the belt interface;

the center assembly including an inner spine attached to the pivot saddle, an outer spine attached to the inner spine via the height adjustment system and the buffer system; and a shelf attached to the outer spine at least partially supporting the load.

5. The load distribution system of claim 4, wherein the pivot saddle and the belt interface interact to limit a tilt of the pivot saddle from a center of the belt interface.

6. The load distribution system of claim 4, wherein the center assembly is frictionally attached to the belt interface and the shelf.

7. The load distribution system of claim 6, wherein the belt interface and the shelf are configured to accept a plurality of center assemblies having different sizes corresponding to different sized users.

8. The load distribution system of claim 6, wherein the center assembly is configured to be toollessly removed from the shelf or belt interface by applying sufficient force.

9. The load distribution system of claim 1, wherein the height adjustment system includes:

a trigger bar slideably nested within an inner spine;

a trigger ramp configured to communicate with the trigger bar to place the height adjustment system in a locked or unlocked state;

a locking slide slideably nested in a top of the inner spine and configured to communicate with the trigger bar;

in the locked state the trigger bar opens the locking slide forcing the locking slide to engage a floating track preventing movement of the floating track relative to the inner spine;

in the unlocked state the trigger bar closes the locking slide forcing the locking slide to disengage from the floating track.

10. The load distribution system of claim 9, wherein the locking slide and the floating track have a series of interlocking teeth or a friction device preventing movement between the locking slide and the floating track when they are engaged while a minimal amount of force is required to disengage the locking slide from the floating track.

11. The load distribution system of claim 9, wherein a trigger bar spring engaging both the inner spine and the trigger bar forces the trigger bar into the locked state when the trigger bar is not in communication with the trigger ramp.

12. The load distribution system of claim 1 further comprising:

a height adjustment interface configured for the user to lock and unlock the height adjustment system using the height adjustment interface while wearing the load distribution system.

13. The load distribution system of claim 12, wherein the height adjustment interface is remote from the outer shell, and the height adjustment system is communicatively connected to the height adjustment interface.

14. The load distribution system of claim 12 wherein, the height adjustment interface is attached to the belt.

15. The load distribution system of claim 14, wherein the height adjustment interface is in a locked or unlocked state, and the height adjustment interface produces an indication when switched from the locked to unlocked state and vice versa.

16. A load distribution system comprising: an outer shell configured to attach to a user's belt and a load adjacent to the user's back, wherein the outer shell includes: a belt interface attached to the user's belt, a pivot saddle hingedly attached to the belt interface and a center batten assembly including an inner spine attached to the pivot saddle, an outer spine attached to the inner spine via a height adjustment system and a buffer system, and a shelf attached to the outer spine supporting the load; the height adjustment system controlled by the user to select a desired height; and the buffer system protecting the user from shocks associated with the load moving a distance in congruence with a cadence of the user's movement; wherein the buffer system includes a bumper restricting the distance the load can travel to a limited distance about the desired height; wherein the center batten assembly includes an outer spine including a floating track, and wherein the floating track is oriented from a top to a bottom of the center batten assembly and slides substantially along a length of the outer spine; the buffer system includes a bumper attached about a middle of the floating track; and the floating track includes a stopper to contact the top and bottom of the bumper.

17. A load distribution system comprising: a base assembly configured to attach to a waist belt; a center batten assembly having an upper end and a lower end, the lower end of the batten is pivotably connected to the base assembly and extends upwardly from the base assembly to the center batten assembly upper end wherein the center batten assembly includes a buffer system; and a shelf connected to the center batten assembly, wherein the center batten assembly is attached to the base assembly and the shelf and removable by a user; wherein the buffer system includes a bumper restricting the distance the load can travel to a limited distance about the desired height; wherein the center batten assembly includes an outer spine including a floating track, and wherein the floating track is oriented from a top to a bottom of the center batten assembly and slides substantially along a length of the outer spine; the buffer system includes a bumper attached about a middle of the floating track; and the floating track includes a stopper to contact the top and bottom of the bumper.

18. The load distribution system of claim 17, wherein the base assembly includes a pivot saddle hingedly attached to the base assembly; and the center batten assembly attached to the pivot saddle;

wherein the center batten assembly includes an outer spine attached to an inner spine via a height adjustment system and the buffer system.

19. The load distribution system of claim 18, wherein the height adjustment system includes:

a trigger bar slideably nested within the inner spine;

a trigger ramp configured to communicate with the trigger bar to place the height adjustment system in a locked or unlocked state;

a locking slide slideably nested in a top of the inner spine and configured to communicate with the trigger bar;

in the locked state the trigger bar opens the locking slide forcing the locking slide to engage a floating track preventing movement of the floating track relative to the inner spine;

in the unlocked state the trigger bar closes the locking slide forcing the locking slide to disengage from the floating track.

20. The load distribution system of claim 17, wherein the bumper is capable of being compressed from both the top and the bottom.

* * * * *